United States Patent [19]

Jarman

[11] 4,114,418

[45] Sep. 19, 1978

[54] MATERIAL HANDLING MEANS

[76] Inventor: David J. Jarman, P.O. Box 181, R.R. 3, Aurora, Ind. 47001

[21] Appl. No.: 748,937

[22] Filed: Dec. 9, 1976

[51] Int. Cl.[2] ..... B21D 43/00

[52] U.S. Cl. ..... 72/386; 72/389; 72/419; 72/421

[58] Field of Search ..... 72/418, 420, 421, 428, 72/461, DIG. 21, 36, 386, 389, 419

[56] References Cited

U.S. PATENT DOCUMENTS

| | | | |
|---|---|---|---|
| 2,429,387 | 10/1947 | Buchheim | 72/DIG. 21 |
| 3,618,349 | 11/1971 | Roch | 72/DIG. 21 |
| 3,740,996 | 6/1973 | Hix | 72/461 |
| 3,748,890 | 7/1973 | Thatcher | 72/386 |
| 3,826,119 | 7/1974 | Marotto | 72/DIG. 21 |
| 3,855,840 | 12/1974 | Kawano | 72/418 |
| 3,861,193 | 1/1975 | Morguson | 72/421 |

FOREIGN PATENT DOCUMENTS

| | | | |
|---|---|---|---|
| 1,358,832 | 7/1974 | United Kingdom | 72/420 |

*Primary Examiner*—C.W. Lanham
*Assistant Examiner*—D. M. Gurley
*Attorney, Agent, or Firm*—Alter and Weiss

[57] ABSTRACT

A press brake plate lifter has horizontally extending lift rails pivotally mounted to a supporting framework, for supporting and lifting sheet stock during press brake operations. The lift rail pivot axis is coextensive with the bending axis of the press brake die. The material support lift rails are horizontally adjustable to accommodate sheet stock of varying dimensions, while plate clamps mounted on the lift rails hold the sheet stock firmly during the bending operation.

15 Claims, 6 Drawing Figures

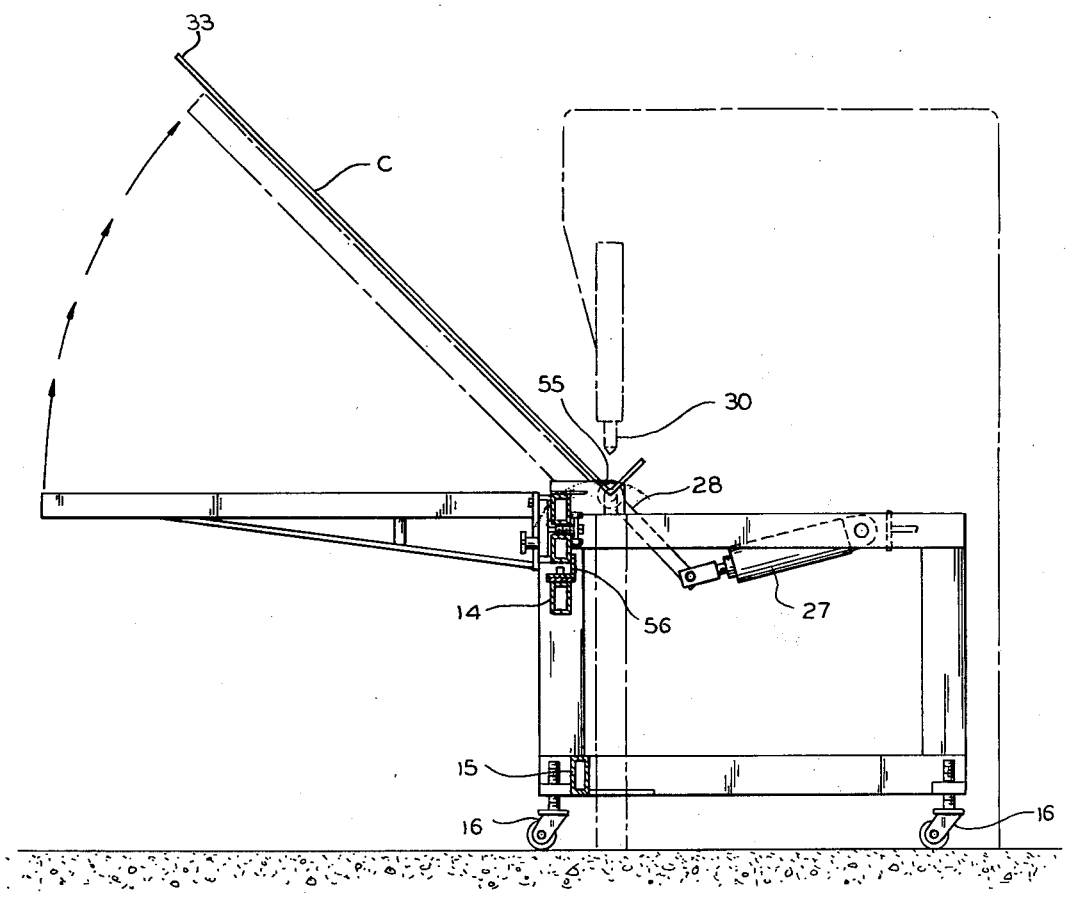

MATERIAL HANDLING MEANS

This application relates generally to material support means and more particularly to a press brake plate lifter for supporting and raising sheet stock during bending operations.

Use of a press brake to form lips, edges and flanges on flat sheet stock is wide and well-known. Press brakes commonly have a lower die which remains stationary, and an upper ram adapted to precisely meet said lower die. The die and ram may be formed with mating surfaces cut to the angle to which the flat stock is intended to be bent. For shorter, lighter pieces of stock, handling during the bending operation presents little problem. It is when longer, larger, heavier pieces of flat stock must have edges or flanges formed thereon that material handling precision becomes critical. To effectively and efficiently form the bend necessary, the flat stock must be raised as the die and ram meet to effect a clean precise bend.

Attempts have been made to design a material lifting apparatus adequate to support large pieces of flat stock during press brake operations. One such device is the subject of U.S. Pat. No. 2,922,459 and features a hydraulically operated bed and supporting framework intended to lift the plate during bending and lower it thereafter. However, several important problems encountered during normal bending operations remain unsolved.

Ideally, the force necessary to effect a clean bend should be concentrated along the line formed when the ram and die of the press brake meet. Conventional material handling and lifting means tend to produce a "back bend" effect, in the area directly in front of the ram-die-jointure. This is especially critical in working with thin stock which may more easily retain some permanent evidence of distortion or deformation.

Another problem is encountered when stock to be bent must be firmly gripped during bending operations. Since such stock comes in a wide variety of shapes and sizes, it has not heretofore been possible to utilize a handling means adapted to adjustably fit such stock.

Another problem encountered has been the difficulty and permanence with which such material handling devices must be attached to the press brake being used, requiring such devices to be virtually custom-designed, and limiting use of such a device to a single press brake.

This invention has therefore the following object:

- to provide material handling means to lift and support stock during bending operations as carried out on a press brake;
- to provide such material handling means in forms whereby the bending moment applied to the flat stock is concentrated along the bend line of the press brake;
- to provide such material handling means in forms easily transferable from press brake t4 press brake;
- to provide such material handling means in forms adjustable to the size of the stock intended to be bent; and
- to provide such material handling means in forms adaptable to securely clamp work stock to said handling means during bending operations.

These and further objects will become more apparent upon consideration of the accompanying drawings in which.

Figure 1:
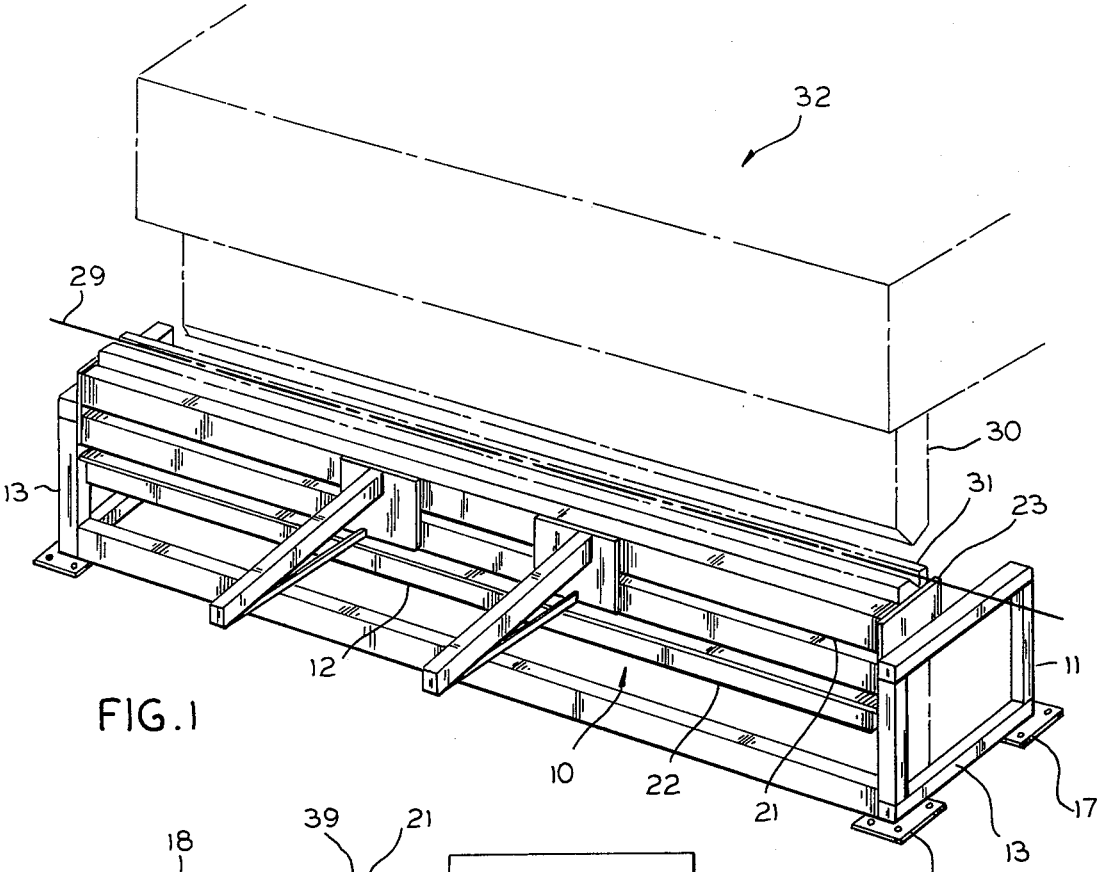
FIG. 1 is a perspective view of the material handling means as positioned with a press brake.

Consistent with the foregoing objects, press brake plate lifter 10 has support frame side members 13 joined by transverse members 14 and 15 in a U-shaped configuration to closely fit the periphery of press brake 32. Lift frame 12 is pivotally mounted to support frame 11 at pivot blocks 26 mounted to side frame members 13. Support rails 18 are laterally adjustably mounted to transverse members 21 and 22 of lift frame assembly 12; cam followers 39, 40 and 41 allow full lateral adjustment while lock knob 43 may be tightened to secure lift frame member 18 after adjustment. Support frame 11 is dimensioned and shaped to co-linearally align pivot axis 29 with the bending axis formed when upper die member 30 meets lower die member 31. Adjustable casters 16 provide portability for plate lifter 10 and vertical adjustability to align said pivot axis with said bend axis. Clamp members 45 mounted on lift frame members 18 securely hold stock during bending operations.

Figure 2:
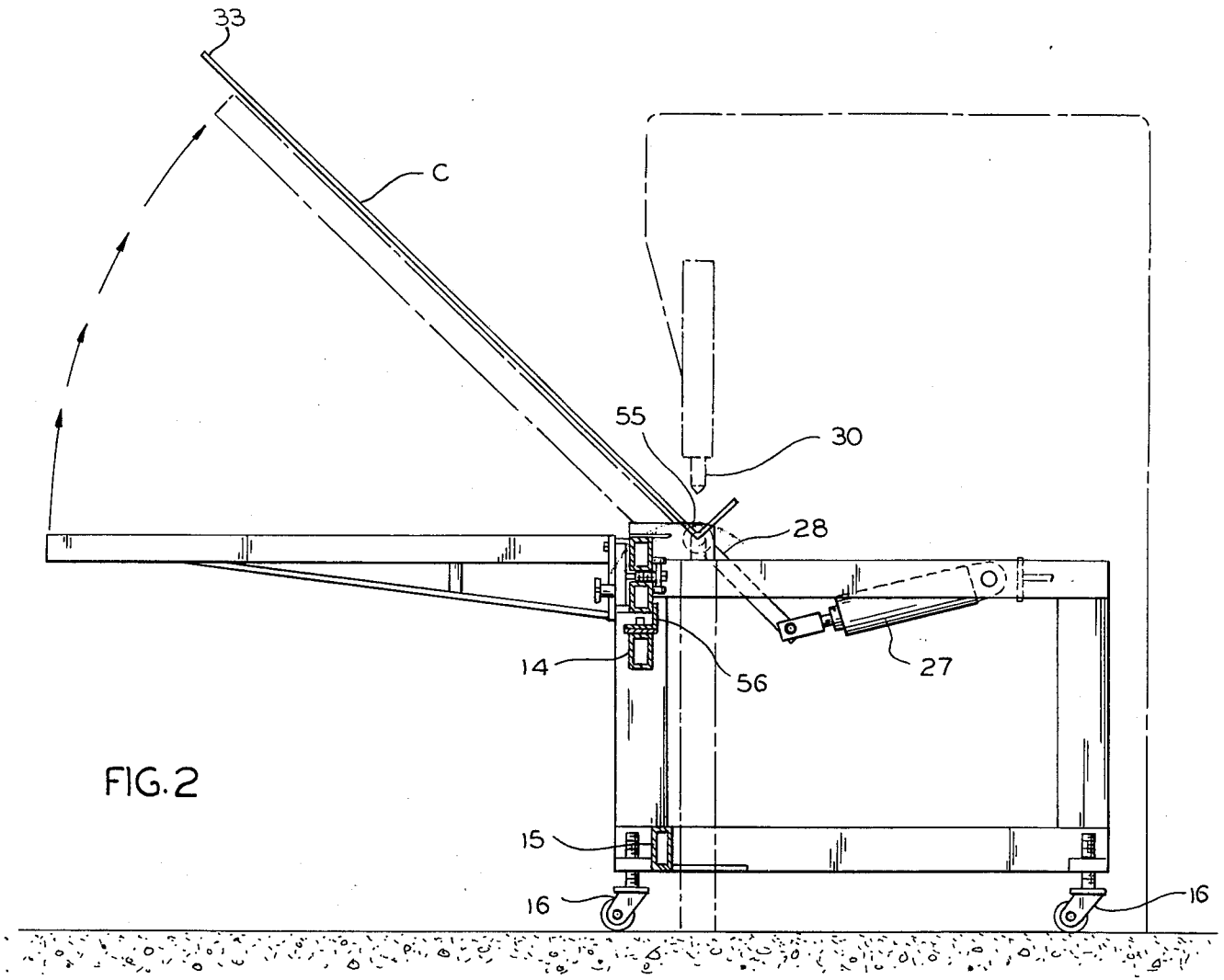
FIG. 2 is a view along 2—2 of FIG. 1.
Figure 4:
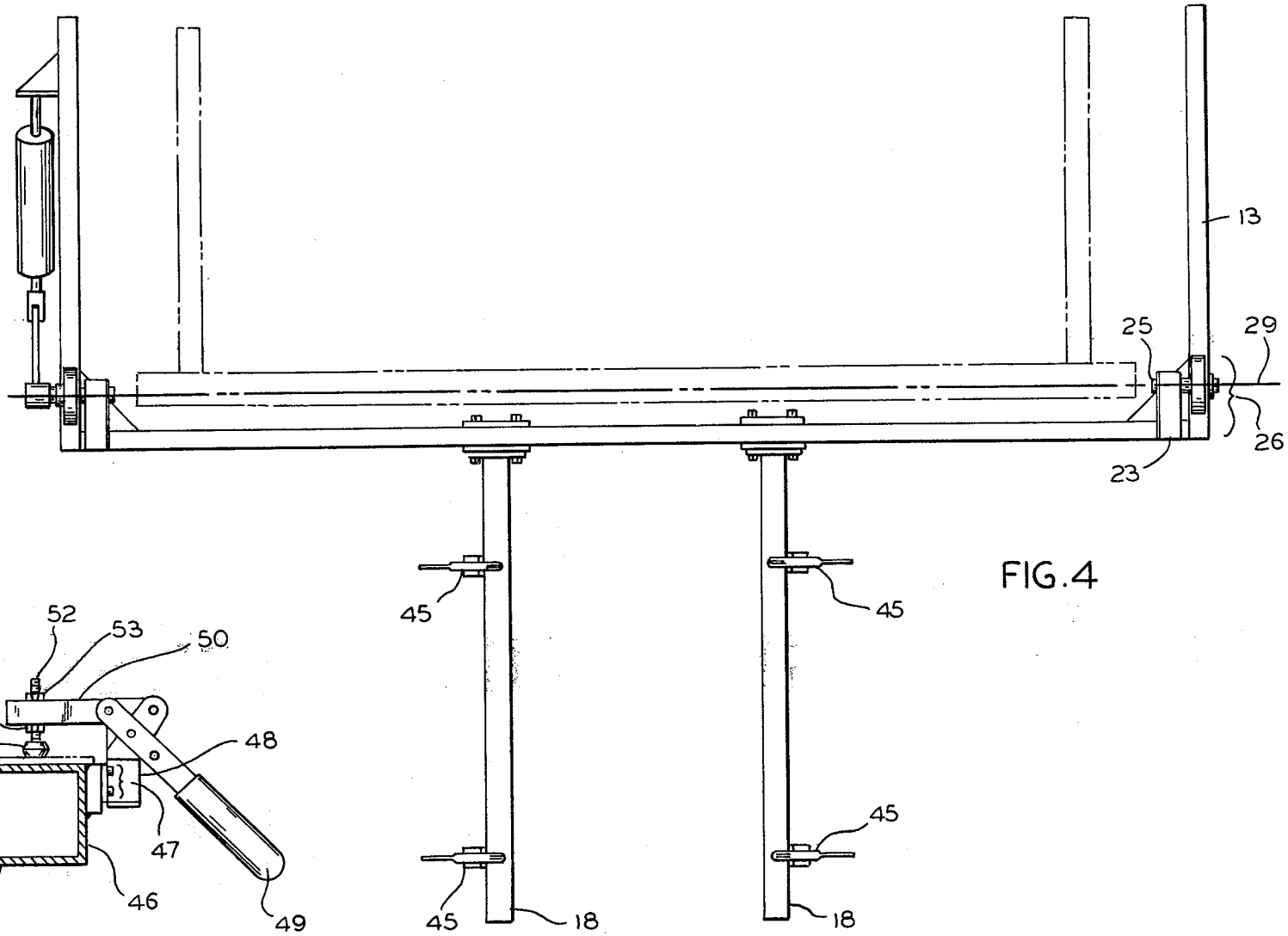
FIG. 4 is a top plan view of the arrangement illustrated in FIG. 1.

Referring to FIG. 1, the numeral 10 indicates generally a press brake plate lifter having a support frame 11, with a lifting frame 12 pivotally mounted thereto. Support frame 11 has side frame members 13 joined by upper transverse support rail 14 and lower transverse rail 15. Heavy duty adjustable casters 16 may be included as illustrated in FIG. 2 whereby plate lifter 10 may be moved from press brake to press brake as required, and may be vertically adjusted as required. Floor mounts 17 as illustrated in FIG. 1 may also be provided for permanent installation. Support frame 11 is thereby somewhat U-shaped and is dimensioned to fit about the outer periphery of press brake 32, as illustrated in FIG. 4. As can be seen in FIG. 1, support frame 11 thereby provides unhindered access to the working surfaces of press brake 32 for purposes of repair or adjustment. Additionally, casters 16, as illustrated in FIG. 2, may be utilized as a vertical height adjustment to assure proper alignment of lifter 10 with die 31.

Figure 3:
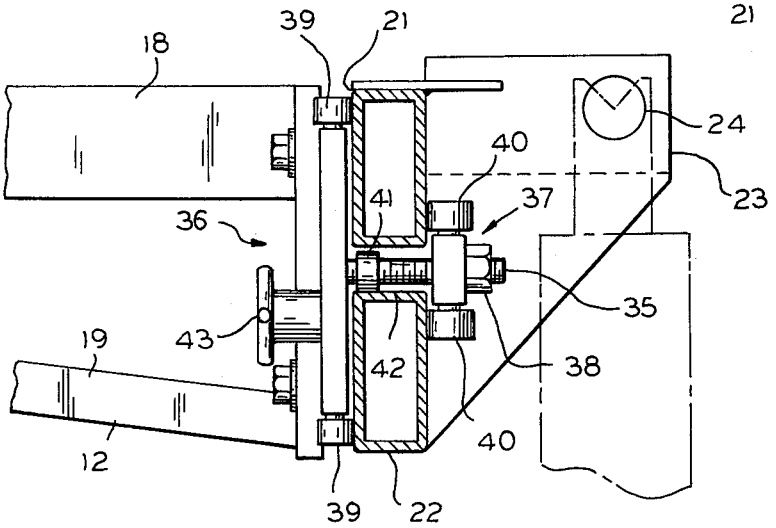
FIG. 3 is a detail view of the lift rail adjusting mechanism shown in FIG. 2.

Lift frame assembly 12 includes lift rails 18 and lift rail braces 19 attached to lift rail carriage assembly 20 as illustrated in FIG. 3. While two such rails are herein illustrated, more may be used if press width or operations require. Transverse lift rail members 21 and 22 extend between and are fastened to fulcrum plates 23. Each fulcrum plate 23 has formed therethrough pivot aperture 24 and is mounted upon pivot pin 25 of pivot pin assembly 26, attached to each side rail support member 13, as shown in FIG. 4.

Movement of lift rails 18 is effected by air cylinder 27 acting through air cylinder linkage 28 as illustrated in FIG. 2.

Figure 6:
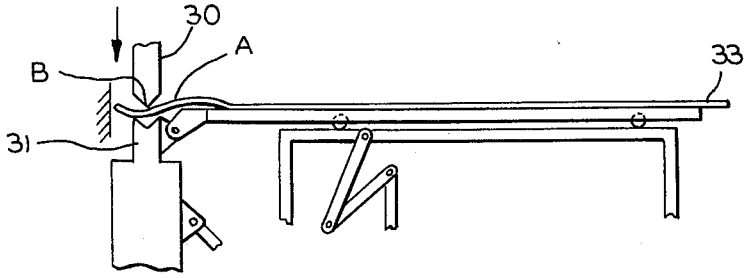
FIG. 6 Prior Art
FIG. 6 is a side view of a prior art device illustrating the "back bend" effect.

Lift rail transverse members 21 and 22, and support frame transverse members 14 and 15, together with side supports members 13, are dimensioned to position the axis of rotation 29 of lift rail assembly 12 to coincide with the bend axis formed by ram 30 and die 31 of press brake 32. Placing pivot axis 29 forward to said bend axis may result in "rippling" during bending due to the application of a bending moment at point A (FIG. 6) above the pivot axis of the lift rail assembly while the cause of "back bend" has not been precisely determined, it is believed that it is caused by the force exerted by the lifting substructure, upon the flat stock, other than along the line at which the ram and die of the press brake meet the flat stock. The present invention, however, by placing pivot axis 29 to coincide with said bending axis concentrates a bending moment applied to flat stock 33 at bend point B, thus minimizing any deformation during the bending operation, it is believed, by concentrating the force exerted by the lift substructure along the same line at which the ram and die meet flat stock 33.

Another problem encountered during bending operations occurs when the stock to be bent is too large to be adequately or securely supported by lift rails 18. Typically, this occurs when the stock to be bent is either significantly wider or narrower than the distance between adjacent lift rails 18. To overcome such difficulties, lift rails 18 are fully adjustable for the entire width of the plate lifter.

As detailed in FIG. 3, lift rail channels 21 and 22 are spaced apart to enable shaft 35 to extend therethrough. At one end of shaft 35, front lift rail carriage 36 is mounted while at the other end, rear lift rail carriage 37 is secured by lock nut assembly 38. Front lift rail carriage 36 has cam followers 39 as illustrated in FIG. 3, abutting top and bottom lift rail channel members, while rear carriage 37 has cam followers 40 abutting the rear surfaces of lift rail channel members 21 and 22. Cam follower 41 mounted on shaft 35 rests on the upper surface of 42 of lower lift rail channel 22. Lock knob 43 serves as a convenient means to lock or release lift rail carriage assembly 34 and to allow full lateral movement along lift rail channels 21 and 22. Thus, lift rails 18 may be fully adjusted to fit a wide range of flat stock sizes.

Figure 5:
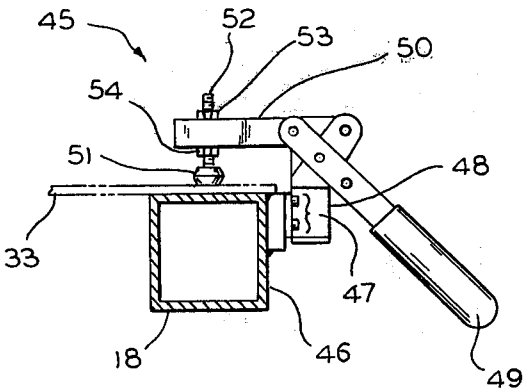
FIG. 5 is a view along 5—5 of FIG. 4.

In addition to providing adequate support for a piece of flat stock, each lift rail 18 has clamp assemblies 45 mounted thereon to secure such stock to the lift rails during lifting operations. As detailed in FIG. 5, each clamp 45 is mounted to lift rail 18 at bracket 46 and is held thereon with bolts 47. Fulcrum block 48 supports handle 49 and clamp arm assembly 50 while clamp foot 51 mounted to threaded shaft 52 may be adjustably positioned with lock nuts 53 and 54 to firmly clamp flat work stock 33 in position during bending operations.

Use of the plate lifter may best be exemplified by describing a typical press brake set up and bending operation.

Plate lifter 10 is first positioned at press brake 18 to bring pivot assembly 24 into co-linear alignment with the center line of die 31, thereby aligning pivot axis 29 with the bending axis of press 32.

Flat stock blank 33 is next selected, and lift rails 18 are laterally adjusted to accommodate said flat stock. Carriage knob 43 is slackened, freeing lift rail carriage assembly 34 and allowing lift rails 18 to be laterally adjusted. When proper adjustment has been reached, carriage lock knob 43 is tightened, precluding further movement.

Flat stock blank 33 is next placed into position on lift rails 18 and is secured in place by use of clamp assemblies 45. Clamp foot 51 is threadably adjusted to accommodate variations in stock thickness, thereby to provide a secure grip when clamped on to engage flat stock blank 33.

Hydraulic control systems, well-known in the art, may be utilized to apply an upward force to lift rails 18, whereby said force offsets gravitational forces exerted on said rails and stock; thus flat stock 33 and lift rails 18 are balanced and little additional force will be required to lift said rails and said material when ram 30 is lowered to contact said material.

Ram 30 is next lowered and, concurrently, air cylinder 27 is activated to elevate lift rails 18 during the actual bending operation, as illustrated at C of FIG. 2, to form bend 55. After bending is complete, ram 30 is raised and air cylinder 27 allows lift rails 18 to return to the at rest position, and to allow clamp assemblies 45 to be released and flat stock blank with completed bend 55 to be removed. Stop member 56, bolted to upper transverse member 14 serves as a rest and stop for lift rails 18 and maintains said lift rails in a horizontal position between bending operations.

Control systems coordinating press brake operation with plate lifter operation are known in the art, and the present invention may readily be adapted to enable bending operations to be essentially "hands off" in nature, increasing operator's safety. The elimination of back bend or rippling during bending operations means less waste and more accurately formed bend than have been heretofore possible, particularly where clamping elements 45 are provided to minimize slippage during bending regardless of the relative thickness of the flat stock to be bent.

While the foreoing has presented a specific embodiment of the invention herein claimed, it is to be understood that this embodiment is presented by way of example only. It is expected that others in the art may perceive variations from the foregoing which nevertheless do not depart from the spirit and scope of the invention.

I claim:

1. In a combination with a mechanical press having a movable die and a fixed die, said movable die and said fixed die meeting at a bending axis, material handling means, said material handling means comprising:

a base frame;

a lift frame;

said lift frame being pivoted to said base frame along a pivot axis, said base frame and said lift frame positioning said pivot axis co-linearly with said bending axis; and means to support material to be processed by said press brake, said material support means being laterally adjustably mounted to said lift frame.

2. The apparatus as recited in claim 1 wherein said lift frame includes spaced apart transverse members; and said material support means includes means to selectively position said material support means selectively along said transverse members, said positioning means including a follower engaging said transverse members, whereby said material support means may be selectively laterally positioned.

3. The apparatus as recited in claim 1 wherein said support frame includes means to adjust the height of said support frame, said height adjustment means enabling an alignment of said pivot axis with said bending axis.

4. The apparatus as recited in claim 1 wherein said support frame includes a pair of side frame members connected by transverse channel members to form a generally U-shaped configuration, said side frame members and said channel members being dimensioned to fit closely about a portion of the periphery of said press brake.

5. The apparatus as recited in claim 1 wherein said support frame include means to selectively move said support frame to and from said press brake.

6. The apparatus as recited in claim 1 wherein said material support means includes at least one clamp, said clamp being adjustable to secure sheet material of varying thicknesses to said material support means.

7. The apparatus as recited in claim 1 wherein said bending axis and said pivot axis are horizontally co-linear.

8. The apparatus as recited in claim 2 wherein said material support means includes at least two material support frame members, said material support frame members being independently selectively laterally positionable.

9. In combination with a mechanical press, having a movable die and a fixed die, said movable die and said fixed die meeting at a bending axis, means to handle material to be processed by said press, said material handling means comprising:

a base frame, said base frame including a pair of side frame members connected by transverse channel members in a generally U-shaped configuration, said base frame being dimensioned to fit closely about the periphery of said press;

a lift frame, said lift frame including a pair of vertically spaced-apart transverse members, said lift frame and said base frame pivotally connected along a pivot axis, said pivot axis co-linearly positioned with said bending axis; and means to support said material, said material support means being laterally adjustably mounted to said lift frame.

10. The apparatus as recited in claim 9 wherein said material support means includes at least one cam follower, said cam follower contacting said transverse members whereby said material support means may be selectively laterally positioned along said transverse members.

11. The apparatus as recited in claim 9 wherein said material support means includes two or more material support members, said material support members independently laterally adjustably mounted to said frame.

12. The apparatus as recited in claim 11 wherein said lift frame members are adapted to extend horizontally when said material handling means is in a lowermost position.

13. The apparatus as recited in claim 9 wherein said material support means includes at least one clamp, said clamp being adapted to mechanically secure sheet material of varying thicknesses to said material support means.

14. The apparatus as recited in claim 9 wherein said transverse members extend parallel to said pivot axis and to said bending axis, and said material support means extend at a right angle to said transverse members.

15. The apparatus as recited in claim 9 wherein said material handling means includes means to hydraulically pivot said lift frame with respect to said base frame.

* * * * *

UNITED STATES PATENT AND TRADEMARK OFFICE

CERTIFICATE OF CORRECTION

PATENT NO. : 4,114,418

DATED : September 19, 1978

INVENTOR(S) : David J. Jarman

It is certified that error appears in the above-identified patent and that said Letters Patent are hereby corrected as shown below:

Col. 1, Line 59 Change "t4" should be --to--.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*